United States Patent [19]

Boeger

[11] Patent Number: 4,462,268

[45] Date of Patent: Jul. 31, 1984

[54] ANTI-TWIST THROTTLE LEVER

[75] Inventor: Frank W. Boeger, East Detroit, Mich.

[73] Assignee: Colt Industries Operating Corp., New York, N.Y.

[21] Appl. No.: 352,364

[22] Filed: Feb. 25, 1982

[51] Int. Cl.[3] ..... G05G 1/04

[52] U.S. Cl. ..... 74/519; 74/513; 74/526; 123/395; 403/363

[58] Field of Search ..... 74/519, 526, 513; 403/100, 101, 102, 119, 161–163, 164, 363, 157, 158, 227; 123/395, 403, 400

[56] References Cited

U.S. PATENT DOCUMENTS

| | | | |
|---|---|---|---|
| 2,450,113 | 9/1948 | Burchett | 123/403 X |
| 2,902,013 | 9/1959 | Biermann | 123/403 X |
| 3,498,156 | 3/1970 | McAllister et al. | 74/513 X |
| 3,919,366 | 11/1975 | Judd | 403/161 X |
| 4,117,809 | 10/1978 | Kittler | 74/526 X |
| 4,341,129 | 7/1982 | Bando | 74/526 X |

*Primary Examiner*—Allan D. Herrmann
*Assistant Examiner*—Frank McKenzie
*Attorney, Agent, or Firm*—Walter Potoroka, Sr.

[57] ABSTRACT

A carburetor having a throttle valve and throttle shaft is shown provided with a throttle shaft lever which has a U-shaped portion carrying a linkage connecting member effective for connection to associated throttle actuating linkage; a sleeve-like spacer is situated about the connecting member and between the legs of the U-shaped portion as to add rigidity thereto.

42 Claims, 3 Drawing Figures

ANTI-TWIST THROTTLE LEVER

FIELD OF THE INVENTION

This invention relates generally to lever means and more particularly to lever means associated with the control and/or positioning of a throttle valve and the like as employed in, for example, a carburetor structure or other means for controlling the induction of an associated combustion engine.

BACKGROUND OF THE INVENTION

Heretofore, it has been accepted practice to provide lever means fixedly secured to the throttle shaft of a throttle valve arrangement whereby, upon rotation of the lever means corresponding opening and/or closing movement of the throttle valve is accomplished.

Because of, among other things, safety considerations such lever means have been provided with a ball-type connecting portion for connection to associated throttle actuating linkage. The provision of such a ball-type connecting means serves to automatically compensate for such conditions as, for example, some misalignment with the associated throttle actuating linkage without any undesirable attendant binding action or the like.

Further, in the prior art, it was accepted practice to provide such a ball-type connecting means as in the form of a pin-like member carrying, at one axial end thereof, a spherical or ball-like portion. The body or the shank portion of the pin-like member would be fixedly secured through and in a related aperture formed in the throttle lever while the remainder of the pin-like body portion would extend a substantial distance laterally of the throttle lever means as to have the spherical or ball-like portion spaced a substantial distance laterally away from the lever means thereby providing for the space necessary to enable the associated throttle actuating linkage means to be operatively connected to the spherical or ball-like portion and yet avoid undesirable engagement with the remaining portion of the throttle lever means or other structure in the same general vicinity.

It has been discovered that because of the substantial distance at which the spherical or ball-like portion was laterally displaced from the body of the throttle lever there is force or moment couple experienced by lever portion supporting the generally laterally extending pin-like member. If in the throttle lever system there should arise a condition wherein an abnormal resistance to rotation is experienced and concomitantly an abnormally great force is applied to the spherical or ball-like portion as via the throttle actuating linkage connected thereto, the throttle lever could experience a twisting action which could decidedly alter or effect the otherwise desired operation of such throttle lever means.

Accordingly, the invention as herein disclosed is primarily directed to the solution of the aforestated and other related and attendant problems.

SUMMARY OF THE INVENTION

According to the invention a lever means for actuation of associated throttle valve shaft means comprises lever body means, an attachment portion carried by said lever body means for fixed attachment to said shaft means as to cause rotation of said shaft means upon rotation of said lever body means, lever arm means carried by said lever body means as to be rotatable in unison with said lever body means, said lever arm means comprising first and second leg portions joined to each other by a bight portion as to have said first and second leg portions generally parallel to each other and spaced from each other, a linkage connecting member extending generally transversely to both of said first and second leg portions and operatively carried by each of said first and second leg portions, said linkage connecting member comprising a connecting portion adapted for connection to associated throttle actuating linkage means, said connecting portion being spaced from said first and second leg portions, and spacer means situated generally between said first and second leg portions as to prevent said first and second leg portions from relatively moving toward each beyond the distance established by said spacer means.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
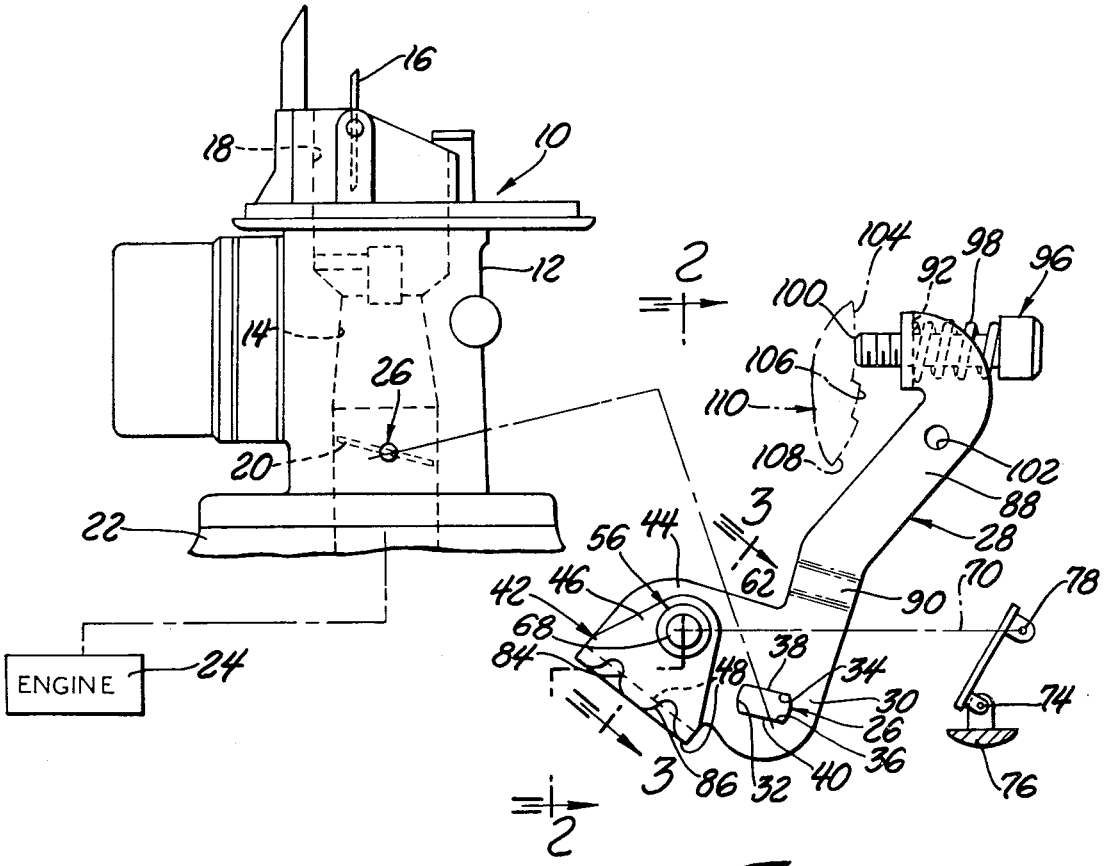
FIG. 1 illustrates, in elevation, a carburetor, in relatively reduced scale, provided with throttle actuating lever means, in relatively enlarged scale, employing teachings of the invention.

Referring now in greater detail to the drawings, FIG. 1 illustrates a carburetor 10 having body means 12 with an induction passage 14. The carburetor 10 may be provided with a choke valve 16 effective for controlling the entrance of the air intake 18 and a throttle valve 20 controlling the flow of motive fluid or combustible mixture to the intake manifold 22 of an associated engine 24. A throttle shaft 26, journalled for rotation, fixedly carries the throttle valve 20 for rotation therewith about the axis of rotation of shaft means 26.

A throttle actuating lever means 28 is illustrated as comprising lever body means 30 with an opening 32 formed therethrough wherein such opening is provided with flatted portions 34 and 36 which cooperatingly operatively engage respective flatted portions 38 and 40 formed on the throttle shaft means 26 thereby assuring the rotation of both the throttle valve means 20 and throttle shaft means 26 upon rotation of the lever means 28.

The lever body means 30 is illustrated as carrying lever arm means 42 which, preferably, is formed integrally with lever body means 30. As illustrated in each of FIGS. 1, 2 and 3, the lever arm means is shown as comprising a first leg or leg-like portion 44 and a second leg or leg-like portion 46 which are laterally (as viewed in either of FIGS. 2 or 3) spaced from each other and joined to each other at their generally lower ends (as viewed in any of the Figures) by a bight portion 48 preferably integrally formed with both legs 44 and 46.

In the preferred embodiment, the body means 30 is of a flat plate-like configuration and, further, leg portion 44 is, in effect, a flat extension of said body means 30.

Figure 2:
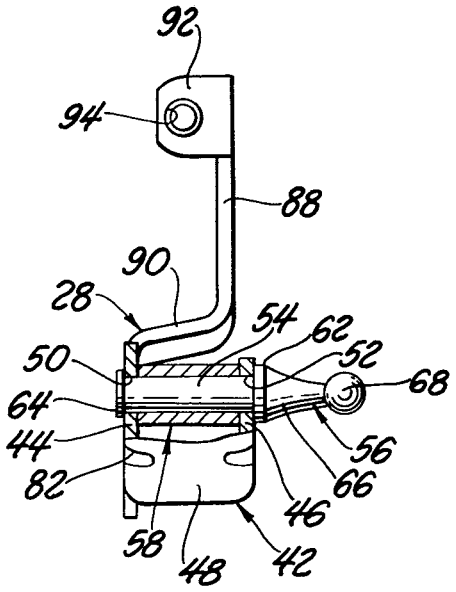
FIG. 2 is a cross-sectional view taken generally on the plane of line 2—2 of FIG. 1 and looking in the direction of the arrows.
Figure 3:
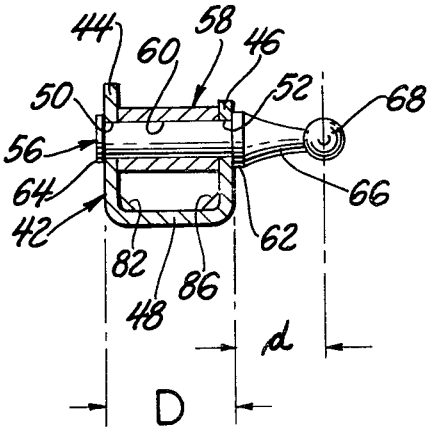
FIG. 3 is a cross-sectional view taken generally on the plane of line 3—3 of FIG. 1 and looking in the direction of the arrows.

As best seen in FIGS. 2 and 3, legs 44 and 46 are respectively provided with generally axially aligned apertures or passages 50 and 52 formed therethrough and such passages 50 and 52 receive the shank portion 54 of a linkage connector means 56. In the preferred embodiment the shank portion 54 is of axially elongated cylindrical configuration.

In the preferred embodiment, a spacer-like member 58 is provided generally between legs 44 and 46. In the embodiment disclosed such spacer means 58 is in the form of a sleeve-like bushing having its opposite axial ends in juxtaposed relationship to legs 44 and 46 while its axial passageway 60 slidably receives the shank portion 54 therethrough. In the embodiment disclosed, the bushing or spacer means 58 would be placed between and in general alignment with apertures or passages 50 and 52 and then the linkage connector means 56 would be inserted through aperture 52, passageway 60 and aperture 50 until a general radially outwardly directed flange or shoulder portion 62, of connector means 56, effectively abutted against the outer side surface leg 46. At that time the opposite axial end of the shank portion 54 would be extending beyond the outer surface of leg 44 and such end would be formed-over, by any suitable means, to form a generally radially outwardly expanded end retainer portion 64 preventing the withdrawal of the connector means 56.

As best seen in FIGS. 2 and 3, the connector means 56 is provided as with a transitional body portion 66 which terminates as in an integrally formed spherical or ball portion 68. As is generally well known in the art, many different types of actuating or motion transmitting linkage means are available which effectively connect to a ball end (such as 68) as by effective entrapment thereof within a cooperating recess or the like formed in such actuating or motion transmitting linkage means. The practice of the invention in no way is limited to a particular actuating or motion transmitting linkage means which may be employed in combination with the lever means of the invention and such actuating or motion transmitting means is schematically illustrated at 70 of FIG. 1.

Still referring to FIG. 1, a foot-operated pedal or lever means 72, as is usually employed in automotive vehicles, is shown as being pivotally mounted as at 74 to related support structure 76 while the generally upper (swingable) end is pivotally or otherwise operatively connected, as at 78, to the actuating or motion transmitting linkage means 70, which, in turn, is operatively connected to ball portion 68 of connector means 56. Generally, as the vehicle operator causes the pedal or lever 72 to rotate in the clockwise direction about pivot means 74, the associated throttle control linkage means 70 (through connector means 56 and legs 44 and 46) causes lever means 28 to rotate clockwise and in so doing cause like rotation of throttle shaft means 26 and throttle valve means 20. Upon release of the pedal means 72, the throttle 20, shaft 26 and lever 28 are rotated counter-clockwise, as through suitable associated spring means (not shown but well known in the art) toward a more nearly fully closed position which may be determined by any of a number of means as, for example, suitable throttle stop cam means.

Referring to each of FIGS. 1, 2 and 3, in the preferred embodiment, the bight portion 48 is provided with a plurality of lindentations 80 and 82 at generally one side and 84 and 86 at the opposite side. Only indentations 82, 84 and 86 are visible with indentation 80 being in a position generally corresponding to indentation 84 but at the opposite side thereof. Such indentations may be formed at an angle of, for example, 45° with respect to legs 44 and 46 thereby effectively forming respective gusset-like reinforcing portions serving to strengthen and rigidify legs 44 and 46 with respect to bight portion 48.

As best shown in FIG. 3, in the preferred embodiment the overall effective width, D, of spaced legs 44 and 46, effectively engaging the shank portion 54 is at least equal to or greater than the distance, d, which is the effective distance from the outer side of the leg to the centerline of ball portion 68. By so doing the effective lever arms of the forces to be exerted by the legs 44 and 46 (in opposing the force applied to ball 68 by linkage means 70 tending to twist connector means 56) is lengthened thereby requiring lesser magnitudes of force.

Further, in the preferred embodiment of the invention, lever body means 30 carries a second lever arm 88 which is preferably integrally formed therewith as by a transitional portion 90 serving to generally off-set the plane of lever arm 88 with respect to body means or portion 30 and leg 44. In the preferred form the general plane of the lever arm 88 is between the general planes of legs 44 and 46 and relatively closer to the general plane of the free leg 46 than to the general plane of leg 44.

The upper or swingable end of lever arm 88 is preferably provided with an integrally formed generally transverse wall-like portion or tab 92 which, in turn, has a threaded aperture 94 formed therethrough. A threadably axially adjustable screw 96 is threadably engaged with apertures 94 and a compression spring 98, generally circumscribing the threaded shank of screw 96, may be provided in order to increase the frictional force between the coacting threaded portions and maintain the end 100 of screw 96 in a selected adjusted position relative to lever arm 88. As shown in FIG. 1, lever arm 88 is preferably provided with an aperture 102 formed therethrough which may be employed for connecting one end of a throttle return spring means (not shown and previously referred to).

Still referring to FIG. 1, when the throttle pedal 72 is released, lever means 28 will rotate counter-clockwise in the throttle-closing direction until, for example, the end 100 of stop screw 96 abuts against one of the discrete steps or surfaces 104, 106, 108 of a fast idle or throttle stop cam means fragmentarily illustrated in phantom line at 110. As is well known in the art, such means as at 110 are often provided and positioned in response to temperature responsive motor means and/or choke valve position whereby, generally during relatively colder engine operation, a relatively higher cam step is presented in the path of throttle-closing movement of screw 96 thereby causing the throttle valve 20 from closing to the fuller degree as when, subsequently, the engine becomes warmer.

It should now be apparent that the invention provides spaced bearing or force reaction surfaces (apertures 50, 52) which are highly effective in countering any tendency of having the lever arm means 42 and/or connector member 56 twisting and loosing its correct configuration due to forces applied to ball 68 by the throttle actuating linkage means 70. Further, the spacer or bushing means 58 being generally captured about shank portion 54 and axially between the leg portions 44 and 46, because of its width further serves to prevent leg portions 44 and 46 from twisting relative to each other as well as preventing leg portions 44 and 46 from moving relative to each other in parallel planes. Obviously, the shoulder or flange-like portions 62 and 64 of connector member 56 further serve to inwardly confine leg portions 46 and 44 thereby preventing such leg portions from bending or twisting outwardly away from each other.

The invention, for purposes of disclosure and description has been illustrated as in association or combination with a carburetor structure having a throttle valve and throttle shaft. It should be apparent that the practice of the invention is not so limited. For example, the invention could be employed with a throttle body assembly, comprised of a body having a throttlecontrolled passage therethrough and employed, for instance, with a fuel injection system or the like. Further, in its still broader aspects, the invention may be employed in any situation for rotatably positioning a shaft in response to actuating forces applied to the lever means of the invention.

Although only a preferred embodiment of the invention has been disclosed and described, it is apparent that other embodiments and modifications of the invention are possible within the scope of the appended claims.

What is claimed is:

1. The combination of a carburetor structure having a throttle valve carried by a rotatably positionable throttle shaft and lever means for the rotatable positioning of said throttle shaft, wherein said lever means comprises lever body means, an attachment portion carried by said lever body means, said attachment portion being effective for fixing said lever body means to said throttle shaft for causing rotatable movement of said throttle shaft upon rotatable movement of said lever body means, lever arm means carried by said lever body means as to be rotatable in unison with said lever body means, said lever arm means comprising first and second leg portions joined to each other by a bight portion as to have said first and second leg portions being spaced from and generally parallel to each other, a linkage connecting member extending generally transversely to both of said first and second leg portions and operatively carried by each of said first and second leg portions, said linkage connecting member comprising a connecting portion adapted for connection to associated throttle actuating linkage means, said connecting portion being spaced from said first and second leg portions, and spacer means situated generally between said first and second leg portions as to prevent said first and second leg portions from relative movement toward each other beyond the distance established by said spacer means.

2. The combination according to claim 1 wherein said spacer means comprises structure physically separate and distinct from said linkage connecting member.

3. The combination according to claim 1 wherein first and second apertures are respectively formed through said first and second leg portions, and wherein said first and second leg portions operatively carry said linkage connecting member by receiving said linkage connecting member in both of said first and second apertures.

4. The combination according to claim 1 wherein said spacer means comprises a sleeve-like configuration, and wherein said spacer means is situated generally about said linkage connecting member.

5. The combination according to claim 1 wherein said spacer means is of cylindrical tubular configuration, and wherein said spacer means is situated as to have said linkage connecting member pass therethrough.

6. The combination according to claim 1 wherein said first leg portion is formed integrally with said lever body means, and wherein said second leg portion terminates in a free end.

7. The combination according to claim 1 and further comprising second lever arms means carried by said lever body means for movement in unison therewith,, wherein said second lever arm means comprises swingable end means, said swingable end means being effective to stop rotation of said lever body means and said throttle shaft means in the throttle-closing direction upon operatively engaging associated abutment means.

8. The combination according to claim 7 wherein said spacer means comprises structure physically separate and distinct from said linkage connecting member.

9. The combination according to claim 7 wherein first and second apertures are respectively formed through said first and second leg portions, and wherein said first and second leg portions operatively carry said linkage connecting member by receiving said linkage connecting member in both of said first and second apertures.

10. The combination according to claim 7 wherein said spacer means comprises a sleeve-like configuration, and wherein said spacer means is situated generally about said linkage connecting member.

11. The combination according to claim 7 wherein said spacer means is of cylindrical tubular configuration, and wherein said spacer means is situated as to have said linkage connecting member pass therethrough.

12. The combination according to claim 7 wherein said first leg portion is formed integrally with said lever body means, and wherein said second leg portion terminates in a free end.

13. The combination according to claim 3 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

14. The combination according to claim 9 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

15. The combination of a throttle valve carried by a rotatably positionable throttle shaft and lever means for the rotatable positioning of said throttle shaft, wherein said lever means comprises lever body means, an attachment portion carried by said lever body means, said attachment portion being effective for fixing said lever body means to said throttle shaft for causing rotatable movement of said throttle shaft upon rotatable movement of said lever body means, lever arm means carried by said lever body means as to be rotatable in unison with said lever body means, said lever arm means comprising first and second leg portions joined to each other by a bight portion so as to have said first and second leg portions being spaced from and generally parallel to each other, a linkage connecting member extending generally transversely to both of said first and second leg portions and operatively carried by each of said first and second leg portions, said linkage connecting member comprising a connecting portion adapted for connection to associated throttle actuating linkage means, said connecting portion being spaced from said first and second leg portions, and spacer means situated generally between said first and second leg portions as to prevent said first and second leg portions from relative movement toward each other beyond the distance established by said spacer means.

16. The combination of claim 15 wherein said spacer means comprises structure physically separate and distinct from said linkage connecting member.

17. The combination according to claim 15 wherein first and second apertures are respectively formed through said first and second leg portions, and wherein said first and second leg portions operatively carry said linkage connecting member by receiving said linkage connecting member in both of said first and second apertures.

18. The combination according to claim 15 wherein said spacer means comprises a sleeve-like configuration, and wherein said spacer means is situated generally about said linkage connecting member.

19. The combination according to claim 15 wherein said spacer means is of cylindrical tubular configuration, and wherein said spacer means is situated as to have said linkage connecting member pass therethrough.

20. The combination according to claim 15 wherein said first leg portion is formed integrally with said lever body means, and wherein said second leg portion terminates in a free end.

21. The combination according to claim 15 and further comprising second lever arm means carried by said lever body means for movement in unison therewith, wherein said second lever arm means comprises swingable end means, said swingable end means being effective to stop rotation of said lever body means and said throttle shaft means in the throttle-closing direction upon operatively engaging associated abutment means.

22. The combination according to claim 21 wherein said spacer means comprises structure physically separate and distinct from said linkage connecting member.

23. The combination according to claim 21 wherein first and second apertures are respectively formed through said first and second leg portions, and wherein said first and second leg portions operatively carry said linkage connecting member by receiving said linkage connecting member in both of said first and second apertures.

24. The combination according to claim 21 wherein said spacer means comprises a sleeve-like configuration, and wherein said spacer means is situated generally about said linkage connecting member.

25. The combination according to claim 21 wherein said spacer means is of cylindrical tubular configuration, and wherein said spacer means is situated as to have said linkage connecting member pass therethrough.

26. The combination according to claim 21 wherein said first leg portion is formed integrally with said lever body means, and wherein said second leg portion terminates in a free end.

27. The combination according to claim 17 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

28. The combination according to claim 23 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

29. Lever means for operative connection to associated shaft means, said lever means comprising lever body means, attachment means carried by said lever body means, said attachment means being effective for fixing said lever body means to said shaft means for causing rotatable movement of said shaft means upon rotatable movement of said lever body means, lever arm means carried by said lever body means as to be rotatable in unison with said lever body means, said lever arm means comprising first and second leg portions joined to each other by a bight portion as to have said first and second leg portions being spaced from and generally parallel to each other, a linkage connecting member extending generally transversely to both of said first and second leg portions and operatively carried by each of said first and second leg portions, said linkage connecting member comprising a connecting portion adapted for connection to associated shaft means actuating linkage means, said connecting portion being spaced from said first and second leg portions, and spacer means situated generally between said first and second leg portions as to prevent said first and second leg portions from undergoing movement relatively toward each other beyond the distance established by said spacer means.

30. Lever means according to claim 29 wherein said spacer means comprises structure physically separate and distinct from said linkage connecting member.

31. Lever means according to claim 29 wherein first and second apertures are respectively formed through said first and second leg portions, and wherein said first and second leg portions operatively carry said linkage connecting member by receiving said linkage connecting member in both of said first and second apertures.

32. Lever means according to claim 29 wherein said spacer means comprises a sleeve-like configuration, and wherein said spacer means is situated generally about said linkage connecting member.

33. Lever means according to claim 29 wherein said spacer means is of cylindrical tubular configuration, and wherein said spacer means is situated as to have said linkage connecting member pass therethrough.

34. Lever means according to claim 29 wherein said first leg portion is formed integrally with said lever body means, and wherein said second leg portion terminates in a free end.

35. Lever means according to claim 29 and further comprising second lever arm means carried by said lever body means for movement in unison therewith, wherein said second lever arm means comprises swingable end means, said swingable end means being effective to stop rotation of said lever body means upon operatively engaging associated abutment means.

36. Lever means according to claim 35 wherein said spacer means comprises structure physically separate and distinct from said linkage connecting member.

37. Lever means according to claim 35 wherein first and second apertures are respectively formed through said first and second leg portions, and wherein said first and second leg portions operatively carry said linkage connecting member by receiving said linkage connecting member in both of said first and second apertures.

38. Lever means according to claim 35 wherein said spacer means comprises a sleeve-like configuration, and wherein said spacer means is situated generally about said linkage connecting member.

39. Lever means according to claim 35 wherein said spacer means is of cylindrical tubular configuration, and wherein said spacer means is situated as to have said linkage connecting member pass therethrough.

40. Lever means according to claim 35 wherein said first leg portion is formed integrally with said lever body means, and wherein said second leg portion terminates in a free end.

41. Lever means according to claim 31 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

42. Lever means according to claim 37 wherein said spacer means comprises a sleeve-like configuration, wherein said spacer means is situated generally about said linkage connecting member, wherein said sleeve-like spacer means comprises first and second axial end portions, wherein said first axial end portion is juxtaposed to one side of said first leg portion and wherein said second axial end portion is juxtaposed to one side of said second leg portion, wherein said linkage connecting member comprises first and second spaced abutment portions, wherein said first abutment portion is juxtaposed to a second side of said first leg portion opposite to said one side of said first leg portion, and wherein said second abutment portion is juxtaposed to a second side of said second leg portion opposite to said one side of said second leg portion.

* * * * *